US005950285A

United States Patent [19]

Porchia et al.

[11] Patent Number: 5,950,285

[45] Date of Patent: Sep. 14, 1999

[54] ENDSTOP AND DOCKING MEANS FOR THERMOPLASTIC BAGS

[75] Inventors: Jose Porchia, Midland; Brian C. Dais, Sanford; Kenneth A. Toney; Judi R. Welsh, both of Midland, all of Mich.; Thomas P. O'Connor, Shelbyville, Ind.; James W. Burke, Cleves, Ohio

[73] Assignee: S. C. Johnson Home Storage Inc., Racine, Wis.

[21] Appl. No.: 08/919,951

[22] Filed: Aug. 29, 1997

[51] Int. Cl.[6] ..... A44B 19/00

[52] U.S. Cl. ..... 24/400; 24/390; 24/399; 24/587

[58] Field of Search ..... 24/400, 399, 390, 24/388, 387, 318, 587

[56] References Cited

U.S. PATENT DOCUMENTS

| | | | |
|---|---|---|---|
| 3,122,807 | 3/1964 | Ausnit | 24/399 |
| 5,189,764 | 3/1993 | Herrington et al. | 24/399 |
| 5,301,394 | 4/1994 | Richardson et al. | 24/400 |
| 5,664,299 | 9/1997 | Porchia et al. | 24/399 |

*Primary Examiner*—Victor N. Sakran

[57] ABSTRACT

In a thermoplastic bag having a reclosable fastener extending along the mouth of the bag and a slider straddling the fastener for opening and closing the fastener, the fastener including two opposing interlocking profiles along the side walls of the bag, the slider adapted to maintain straddling relation with the fastener, an improved endstop means proximate to at least one end of the reclosable fastener, the endstop means being formed from the material of the profiles and rising vertically from the fastener to a height adequate to engage the slider and prevent movement of the slider past the end of the bag. A rail extends along the length of at least one of the profiles on the outside thereof, the rail extending to a point sufficient to permit the slider to cooperate with the rail to maintain straddling relation with the fastener when the slider reaches the endstop. Docking means and methods of making endstop means and docking means are also disclosed.

9 Claims, 3 Drawing Sheets

ENDSTOP AND DOCKING MEANS FOR THERMOPLASTIC BAGS

BACKGROUND OF THE INVENTION

Reclosable fastener assemblies are useful for sealing thermoplastic bags. Such fastener assemblies often include a plastic zipper and a slider. Typically, the plastic zippers include a pair of interlockable fastener elements which form a closure. As the slider moves across the fastener strips, the fastener is opened or closed.

The fastener elements in plastic zippers can take on various configurations. For example, U.S. Pat. No. 5,140,727 describes interlocking rib and groove elements, whereas U.S. Pat. No. 5,007,143 describes rolling action closure elements, and U.S. Pat. No. 4,747,702 describes closure elements that are U-shaped with interlocking hooks.

The sliders for opening or closing the reclosable fasteners are generally shaped so that the slider straddles the profiles. The sliders often include a separator that is inserted between the fastener strips through the closure elements in order to open the fastener. Such a slider is described in U.S. Pat. No. 5,067,208. In other types of sliders, the separator does not penetrate the closure elements, but rather, slides above the closure elements on a specially adapted track located above the closure elements, as described in U.S. Pat. No. 5,007,143. The separators have various shapes. U.S. Pat. No. 5,007,143. The separators have various shapes. For example, U.S. Pat. No. 3,173,184 describes a V-shaped separator, while U.S. Pat. No. 5,067,208 describes a tapered separator with a rounded end.

One of the important features of such reclosable fastener assemblies are the endstops, which prevent the slider from falling off the end of the fastener when the slider reaches the end of the fastener. Endstops have taken on various configurations, such as, for example, riveted end clamps such as those described in U.S Pat. Nos. 5,067,208 and 5,161,286; transverse end stops made from molten material of the fastener strips, as described in U.S. Pat. No. 5,088,971; reciprocating anvils, as described in U.S. Pat. No. 5,131,121; tubular end stops, as described in U.S. Pat. No. 5,405,478; a window structure combined with sealed zipper ends, as described in U.S. Pat. No. 5,442,837; or plastic end clips fused to the zipper as described in U.S. Pat. No. 5,448,807.

Another important feature in some of the closures of the prior art is a docking station, which is means for maintaining the slider in the closed position. Docking stations have taken on various configurations, such as, for example, a notch structure such as that disclosed in U.S. Pat. No. 5,067,208; or a notch structure with diverging ends such as that disclosed in U.S. Pat. No. 5,301,395; or latching means, such as a detent on the slider together with a protrusion on the zipper as disclosed in U.S. Pat. No. 5,189,764.

One disadvantage of these endstops and/or docking stations is that they may be expensive because additional plastic must be added to the fastener to form the endstop. Another disadvantage of these endstops and/or docking stations is that they may require that holes be cut into them, thereby increasing the risk of leakage through the fastener. It would be an advance in the art of reclosable fastener assemblies to minimize leakage through the closure with a simplified endstop design and a simplified docking station design.

SUMMARY OF THE INVENTION

The present invention addresses the above problems. In one aspect, the present invention comprises endstop means proximate to at least one end of the reclosable fastener, the endstop means being formed from the material of the profiles and rising vertically from the fastener to a height adequate to engage the slider and prevent movement of the slider past the end of the bag; wherein a rail extends along the length of at least one of the profiles on the outside thereof, the rail extending to a point sufficient to permit the slider to cooperate with the rail to maintain straddling relation with the fastener when the slider reaches the endstop.

In a second aspect, the present invention comprises end stop means proximate to at least one end of the reclosable fastener, the endstop means being formed from the material of the profiles and rising vertically from the fastener to a height adequate to engage the slider and prevent movement of the slider past the end of the bag; and docking means comprising a recess located in an inside edge of the endstop means, the recess adapted to receive the separating element of the slider, wherein the bottommost closure elements are interlocked below the separating element of the slider while the separating element is docked between the uppermost closure elements of the slider in the recess.

In a third aspect, the present invention comprises a method of forming endstops for the slider comprising: aligning together the opposing profiles at an endstop area proximate to at least one end of the bag; and fusing the profiles at the endstop area to provide a vertical structure for preventing movement of the slider past the ends of the bag, while at the same time keeping the rail intact.

In a fourth aspect, the present invention comprises a method of forming a docking station for the separating element of the slider comprising forcing the slider into an endstop in order to form a recess for receiving the separating element of the slider such that the bottommost closure elements remain interlocked while the separating element is in its docked position.

DESCRIPTION OF THE PREFERRED EMBODIMENTS

Figure 1:
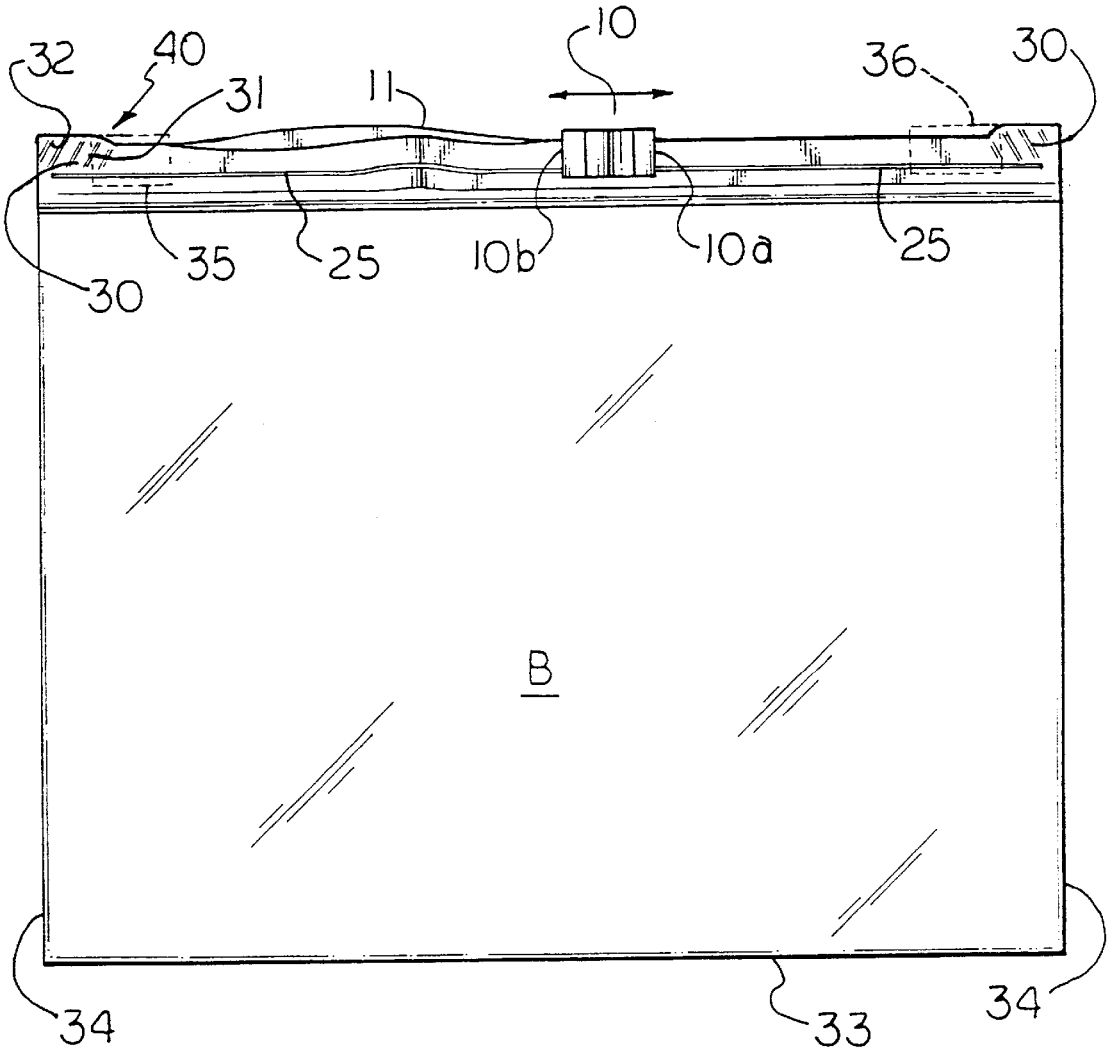
FIG. 1 is a plan view of a thermoplastic bag with a reclosable fastener assembly and endstops of the present invention.

Referring now to FIG. 1, therein is shown a reclosable thermoplastic bag B having a profiled plastic reclosable fastener 11 and a slider 10, with endstops 30 and docking station 40, embodying the present invention. Bag B also has a sealed bottom 33 and two opposing sealed edges 34. Bag B may be made from any suitable thermoplastic film such as, for example, low density polyethylene, linear low density polyethylene, substantially linear copolymers of ethylene and a C3–C8 α-olefin, polypropylene, polyvinyl chloride, mixtures of two or more of these polymers, or mixtures of one or more of these polymers with another thermoplastic polymer.

Figure 2:
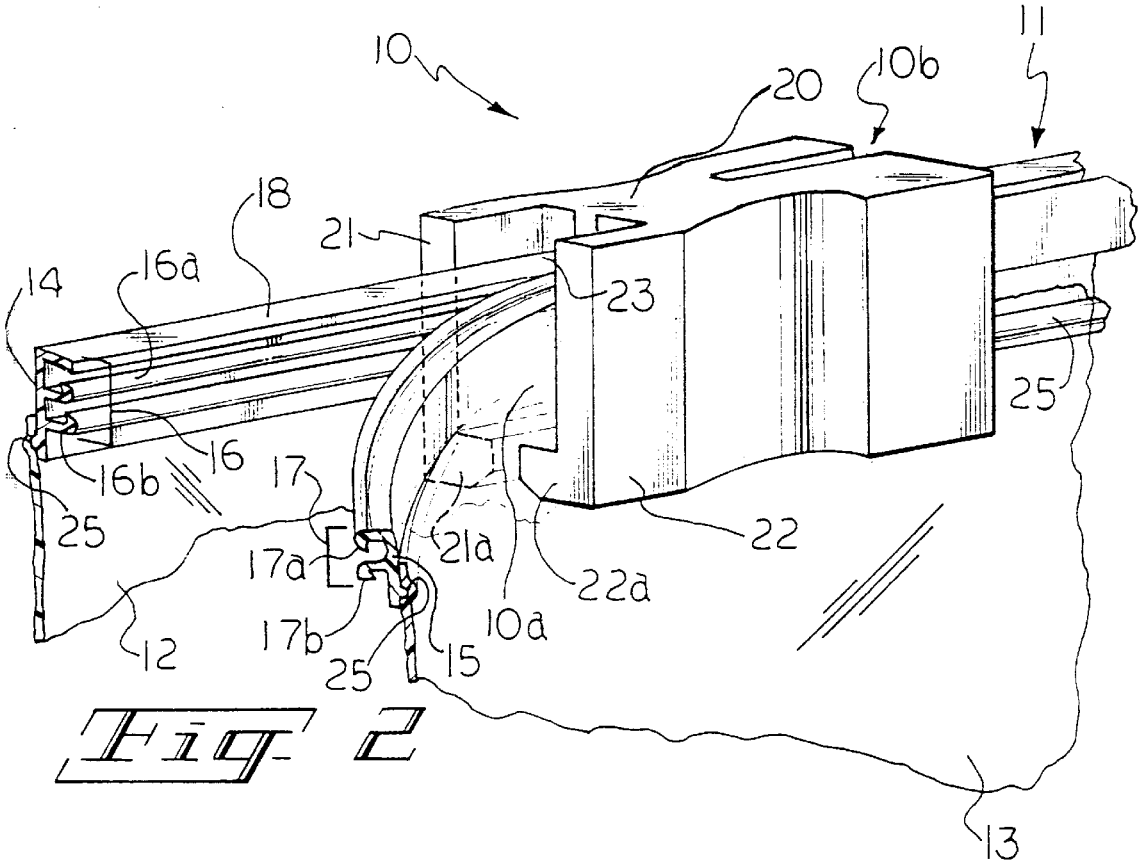
FIG. 2 is a perspective view of a reclosable thermoplastic bag with a fastener assembly.
Figure 3:
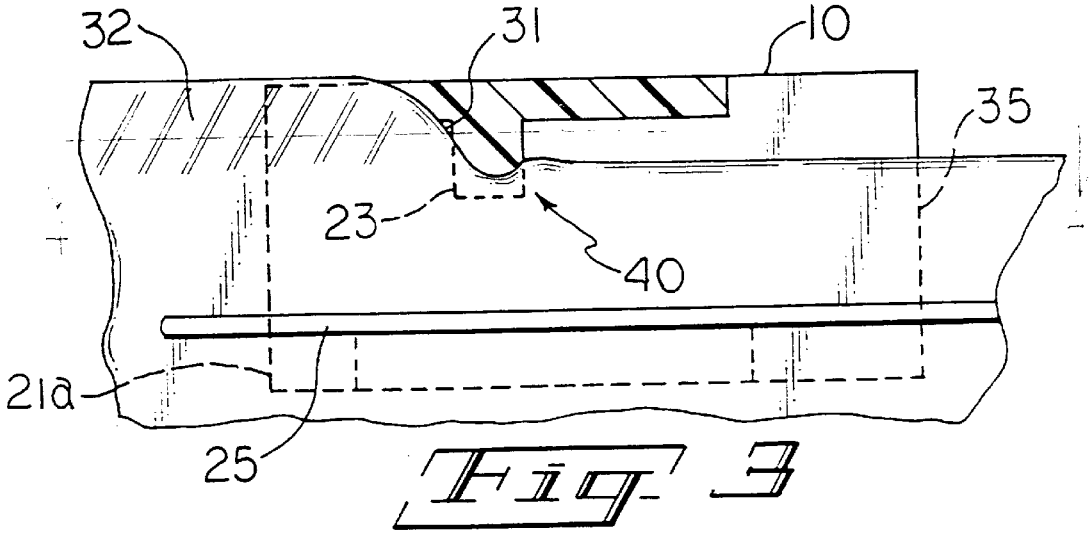
FIG. 3 is an enlarged partial cross sectional view of a slider and endstop of the present invention.
Figure 4:
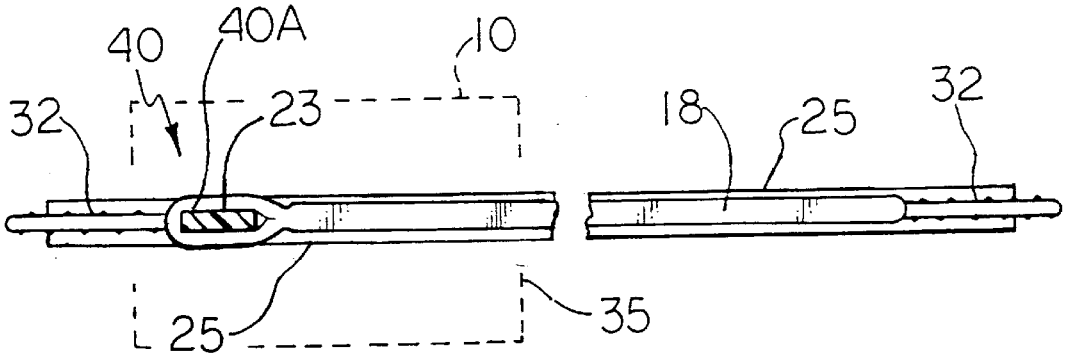
FIG. 4 is a top partial cross sectional view of a slider with a docking station and endstop of the present invention.

Referring now to FIG. 2, the bag B comprises a pair of flexible plastic sheets 12 and 13. The sheet 12 has a top edge having a first fastener strip 14 attached thereto, with an inner surface on the inside of the bag and an outer surface on the outside of the bag. The sheet 13 has a top edge having a second fastener strip 15 attached thereto, with an inner surface on the inside of the bag and an outer surface on the outside of the bag. The strips 14 and 15 may be extruded separately and attached to the respective sides of the bag mouth or they may be extruded integrally with the sides of the bag mouth.

As shown in FIG. 2, the first fastener strip 14 preferably has at least an uppermost closure element 16*a* and a bottommost closure element 16*b* which project laterally from the inner surface of strip 14. Likewise, the second fastener strip 15 preferably has at least an uppermost closure element 17*a* and a bottommost closure element 17*b* which project laterally from the inner surface of strip 15. When the bag is closed, closure elements 16*a* and 16*b* interlock with corresponding closure elements 17*a* and 17*b*. As shown in FIG. 2, closure elements 16*a*, 16*b*, 17*a* and 17*b* have hooks on the ends of the closure elements, so that the hooks can lock onto each other and the fastener strips 14 and 15 remain interlocked when the bag is closed, thereby forming a seal. Under normal use, the seal advantageously forms a barrier to liquids. Fastener strips 14 and 15 can each have more than two closure elements, so that any number of closure elements can be disposed between the uppermost and bottommost closure elements. The closure elements can be any shape, such as a rib and groove shape as described in U.S. Pat. No. 5,140,727, or an angled hook shape, as described in U.S. Pat. No. 4,747,702.

When the bag B is open, fastener strips 14 and 15 are separated from each other. As shown in FIG. 2, closure elements 16*a*, 17*a*, 16*b*, and 17*b* have complementary cross-sectional shapes such that they are interlocked by pressing the fastener strips 14 and 15 together. The pressing action is preferably accomplished by pinching means positioned proximate to a pinching end 10*b* of the slider 10, described hereinbelow.

Referring again to FIG. 1, the slider 10 moves between a closed position 35 and an open position 36. Thus, when the slider 10 reaches the closed position 35 at one end of the fastening strips, the bag is closed, and the closure elements are interlocked throughout substantially their entire length. When the slider reaches the open position 36 at the opposite end of the fastening strips, the bag is open and the closure elements are disengaged throughout most of their length. It should be understood that it is sufficient for the bottommost closure elements 16*b* and 17*b* to be interlocked with each other throughout substantially their entire length, in order for the bag to be closed. Preferably, the uppermost closure elements 16*a* and 17*a* are also interlocked with each other.

Referring now to FIG. 2, the straddling slider 10 comprises an inverted U-shaped member having a top 20 for moving along the top edges of the strips 14 and 15. The top 20 can extend the entire length of the slider 10 but it need not do so. The slider 10 has side walls 21 and 22 depending from the top 20. Side walls 21 and 22 extend downward along the outer surface of the fastener strips 14 and 15, to a point below the uppermost closure elements 16*a* and 17*a*, so that at least a portion of the fastener strips 14 and 15 are held between the side walls 21 and 22. Thus, side walls 21 and 22 cooperate with the strips 14 and 15 so that, as the slider moves between the open and closed position, strips 14 and 15 are received between the side walls 21 and 22.

As shown in FIG. 2, side walls 21 and 22 extend from a separating end 10*a* of the slider to pinching end 10*b* of the slider. Pinching means are preferably positioned proximate to the pinching end 10*b*. The effect of the pinching means is to pinch, or squeeze the fastening strips together, thereby forcing the closure elements 16*a* 16*b* 17*a* and 17*b* into an interlocked relationship.

Pinching means can include, for example, vertical ribs along the inside of sidewalls 21 and 22, which are spaced close together. The close spacing of the ribs forces the fastener strips together, thereby interlocking the closure elements. Pinching means can also include closely spaced walls proximate to the pinching end 10*b*. In this manner, the sidewalls 21 and 22 are tapered so that the space between the sidewalls at the pinching end 10*b* is narrower than the space between the sidewalls at the separating end 10*a*. The close spacing of the walls forces the fastener strips together. A combination of ribs and tapered walls can also be used. Preferably, the closure elements are pinched together all at once, i.e., the uppermost closure elements 16*a* and 17*a* are pressed together at approximately the same time that the bottommost closure elements 16*b* and 17*b* are pressed together.

A separating leg 23 depends from the top 20 between the side walls 21 and 22 and preferably extends past at least one uppermost closure element 16*a* or 17*a*. The separating leg 23 can be positioned anywhere along the top 20, although preferably, the separating leg 23 is positioned away from the pinching end 10*b* of the slider.

Advantageously, the separating leg 23 does not extend all the way through the bottommost closure elements. Rather, the separating leg 23 preferably extends past at least one of the uppermost closure elements 16*a* or 17*a* but does not extend far enough to reach between the bottommost closure elements 16*b* and 17*b*.

When the slider 10 is moved toward the open position 36, the pinching end 10*b* of the slider leads, and the separating end 10*a* of the slider trails, so that the separating leg 23 disengages the closure elements. When the slider 10 is moved toward the closed position 35, the separating end 10*a* leads and the pinching end 10*b* trails, so that pinching means near the pinching end 10*b* squeezes the closure elements together into engagement. The spacing between the bottommost closure elements 16*b* and 17*b* and the uppermost closure elements 16*a* and 17*a*, should be sufficient so that the bottommost closure elements 16*b* and 17*b* are pulled open as the separating leg 23 forces the uppermost closure elements apart when the slider moves toward the open position 36.

The fastening assembly optionally includes means for maintaining the slider in straddling relation with the fastener strips 14 and 15. In the embodiment shown in FIGS. 1–4, the means for maintaining the slider in straddling relation includes rail 25 on the outer surface of at least one of the fastening strips 14 and/or 15. The rail 25 is adapted to cooperate with shoulders 21*a* and 22*a* on the side walls of the slider. Shoulders 21*a* and 22*a* project inwardly from the depending side walls 21 and 22, respectively, of the slider, at a point at or below the profiles 16 and 17. The shoulders 21*a* and 22*a* act as means for maintaining the slider 10 in straddling relation with the fastening strips 14 and 15 by grasping the lower surfaces of rail 25. The rails 25 thus act as handles for the slider to hold onto, such that the slider 10 maintains the straddling relation with the fastening strips and does not fall off the bag. The shoulders can be continuous or intermittent along the length of the slider.

Rail 25 extends along the length of the outer surface of at least one of fastener strips 14 and/or 15 at a point below the uppermost closure elements 16*a* and 17*a*. The rail 25 extends along the profile to a point sufficient to maintain the slider 10 in straddling relation when the slider 10 is in the closed position 35. Thus, in the embodiment shown, when the slider 10 is in the closed position 35, at least a portion of the rail 25 is grasped by shoulder 21*a* and/or 22*a*. Preferably, when the slider 10 is in the open position 36, at least a portion of rail 25 is grasped by shoulder 21*a* and/or 22*a*.

The rail 25 can be attached to the fastener strips by any desired means, such as, for example, by extruding with the fastener strips, heating, gluing, or snapping in place. The rails can also result from the difference in thicknesses between the fastener and the bag.

Referring again to FIG. 1, a bag of the present invention includes endstop means 30 proximate to at least one end of the reclosable fastener. The endstop means 30 prevent the slider 10 from moving beyond the end of the bag once the slider 10 reaches the closed position 35 and/or open position 36. The endstop means 30 are formed from the material of the profiles and rise vertically from the fastener to a height adequate to engage the slider 10 and prevent movement of the slider 10 past the end of the bag. The manner in which the endstops work is that the slider 10 comes into contact with an inward edge 31 of the endstop 30 when the slider 10 reaches the end of its travel at the closed position 35 and/or the open position 36. The slider 10 cannot move past the endstop 30 because the endstop 30 rises vertically from the bag, thereby blocking further movement by the slider. The term "rises vertically" is defined herein to mean that the endstop 30 rises upward from the fastener strip when viewed as in FIG. 1. Thus, the endstop is in the same plane as the bag, as opposed to extending transversely out of the plane of the bag. Preferably, an end stop 30 is proximate to both the closed position 35 and the open position 36.

The endstops 30 are advantageously formed by first aligning together the opposing profiles at an endstop area proximate to at least one end of the bag; and then fusing the profiles at the endstop area to provide a vertical structure for preventing movement of the slider past the ends of the bag, while at the same time keeping the rail intact. The endstop area should be big enough to prevent the slider from moving past the end of the bag but not so big as to significantly reduce the mouth width of the bag. Preferably, the profiles are fused by directing ultrasonic energy to the endstop area. The endstops 30 can have any desired shape. For example, the endstops can be triangular, rectangular, trapezoidal, or any other desired shape.

Optionally, the endstops 30 have ridges 32 disposed along the endstops. The ridges 32 can be oriented vertically, as shown, or the ridges 32 can be oriented horizontally or diagonally. The resulting raised endstops 30 perform the dual function of stops for the ends of the fastener 11 to prevent the slider 10 from going off past the end of the fastener 11 and they also hold the two profiles 16 and 17 together to prevent the bag from opening in response to stresses applied to the fastener strips through normal use of the bag. The endstops 30 also provide a convenient finger grip for the user when moving the slider 10.

In certain embodiments, the present invention also includes docking means 40. The term "docking means" is defined herein to mean a parking spot where the separating element 23 of the slider 10 is seated when the slider 10 is in the closed position 35. When docking means 40 are present, the docking means 40 comprises a recess 40*a* located in the inside edge 31 of the endstop means 30 proximate to the closed position 35, the recess 40*a* being adapted to receive the separating element 23 of the slider 10. Advantageously, the docking means 40 permits the bottommost closure elements 16*b* and 17*b* to be interlocked below the separating element 23 of the slider 10 while the separating element 23 is seated between the uppermost closure elements 16*a* and 17*a* of the slider 10 in the recess 40*a*. In this manner, because the bottommost closure elements 16*b* and 17*b* are interlocked, the docking means 40 acts to minimize leakage through the fastener.

Such a feature is important because it prevents the separating element 23 from moving and separating the closure elements, so that a bag incorporating the zipper and slider of the present invention does not inadvertently open.

The docking means 40 of the present invention is advantageously formed by forcing the slider into the softened endstop in order to form the recess. Preferably, the endstop area is first softened by, for example, directing ultrasonic energy toward the endstop. However, the endstop can be softened by any other desired method.

The slider can be forced into the softened endstop using any desired method. For example, the slider can be forced into the endstop by holding the slider steady while the fastener is moved past the slider. Or, the fastener can be held steady while the slider is moved into the endstop.

Preferably, at least one of the fastening strips 14 or 15 includes a flange 18 positioned above uppermost closure element 16*a* along the length of fastener strip 14, as shown in FIG. 2. When the fastening assembly is closed, flange 18 covers the uppermost closure elements 16*a* and 17*a*. There may be a flange on both fastening strips, if desired.

The slider 10 may be made in multiple parts and welded together or the parts may be constructed to be snapped together. The slider 10 may also be of one piece construction. The slider can be made using any desired method, such as, for example, injection molding or any other method. The slider can be molded from any suitable plastic such, for example, as nylon, polypropylene, polystyrene, acetal, toughened acetal, polyketone, polybutylene terephthalate, high density polyethylene, polycarbonate, or ABS. The slider can be clear, opaque, or colored.

The fastener strips of the present invention can be made using methods well known in the art, such as, for example by blow or cast extrusion. The slider can be attached to the fastener strips using methods such as causing reciprocal movements of the clasp using a tool, as described in U.S. Pat. No. 4,262,395, through a hinge structure which attaches wings to the body of the slider, as described in U.S Pat. No. 5,067,208, through a rigidizing structure as described in U.S Pat. No. 5,283,932, or through in-place assembly.

What is claimed is:

1. In a thermoplastic bag having a reclosable fastener extending along the mouth of the bag and a slider straddling the fastener for opening and closing the fastener, the fastener comprising two opposing interlocking profiles along the side walls of the bag, with the slider adapted to maintain a straddling relationship with the fastener, the improvement comprising:

endstop means proximate to at least one end of the reclosable fastener, the endstop means being formed from the material of the profiles and rising vertically from the fastener to a height adequate to engage the slider and prevent movement of the slider past the end of the bag, said endstop having ridges disposed in the surface thereof;

wherein a rail extends along the length of the outside of at least one of the profiles (on the outside thereof), the rail extending to a point sufficient to permit the slider to cooperate with the rail to maintain said straddling relationship with the fastener when the slider reaches the endstop.

2. The bag of claim 1 wherein the ridges are oriented vertically.

3. In a thermoplastic bag having a reclosable fastener extending along the mouth of the bag and a slider straddling the fastener for opening and closing the fastener, the fastener comprising two opposing interlocking profiles along the side walls of the bag, each of the two profiles including at least an uppermost closure element and a bottommost element, the uppermost closure elements and the bottommost closure elements adapted to interlock with one another, the slider including a separating element which is inserted between the profiles to a point past at least one of the uppermost closure elements but not past the bottommost closure elements, the improvement comprising:

endstop means proximate to at least one end of the reclosable fastener, the endstop means being formed from the material of the profiles and rising vertically from the fastener to a height adequate to engage the slider and prevent movement of the slider past the end of the bag; and docking means comprising a recess located in an inside edge of the endstop means, the recess adapted to receive the separating element of the slider, wherein the bottommost closure elements are interlocked below the separating element of the slider while the separating element is docked between the uppermost closure elements of the slider in the recess.

4. The bag of claim 3 wherein a rail extends along the length of at least one of the profiles on the outside thereof, the rail extending to a point sufficient to cooperate with the slider to maintain straddling relation with the fastener when the slider reaches the endstop.

5. The bag of claim 4 wherein the endstop means includes ridges disposed along the endstop means.

6. The bag of claim 5 wherein the ridges are oriented vertically.

7. In a thermoplastic bag formed from a pair of thermoplastic sheets having top edges with a reclosable fastener extending therealong and including a slider for straddling the fastener for opening or closing the fastener, the fastener comprising two opposing interlocking profiles and a rail extending along the outside length of at least one of the profiles to a point sufficient to permit the slider to cooperate with the rail to maintain said straddling relationship with the fastener when the slider reaches an endstop, and endstops for the slider proximate at least one end of the reclosable fastener, the improvement wherein the endstops comprise fused profile material having ridges disposed therein, the endstops provide a verticle structure for preventing movement of the slider past the ends of the bag, and said rail remains intact in the endstop area.

8. In a thermoplastic bag formed from a pair of thermoplastic sheets having top edges with a reclosable fastener extending therealong and including a slider with a separating element which straddles the fastener for opening or closing said fastener, said fastener comprising two opposing interlocking profiles, each of said profiles having at least an uppermost closure element and a bottommost closure element, the uppermost closure elements and the bottommost closure elements adapted to interlock with one another, the separating element of the slider extending between the profiles to a point past at least one of the uppermost closure elements but not past the bottommost closure elements, the fastener having at least one endstop at an end of the fastener to prevent the slider from moving past the end of the fastener, the improvement wherein said endstop comprises fused profile material having a docking station for said separating element of the slider, said docking station comprising a recess in the endstop formed by forcing the separating element into said endstop when said endstop is softened, and wherein said bottommost closure elements remain interlocked while said separating element is in the docking station.

9. The method of claim 8 wherein at least one of the endstops is softened by directing ultrasonic energy toward the endstop.

* * * * *